US006567993B2

(12) United States Patent
Robertson

(10) Patent No.: US 6,567,993 B2
(45) Date of Patent: May 27, 2003

(54) SOCCER HEADBAND

(76) Inventor: Donald R. Robertson, 170 W. State St., Pasadena, CA (US) 91105

( * ) Notice: Subject to any disclaimer, the term of this patent is extended or adjusted under 35 U.S.C. 154(b) by 199 days.

(21) Appl. No.: 09/756,421

(22) Filed: Jan. 8, 2001

(65) Prior Publication Data

US 2001/0047537 A1 Dec. 6, 2001

Related U.S. Application Data

(60) Provisional application No. 60/175,452, filed on Jan. 9, 2000.

(51) Int. Cl.[7] ..... A42B 3/00

(52) U.S. Cl. ..... 2/411; 2/171; 2/425; 2/455; 2/267; 2/DIG. 11

(58) Field of Search ..... 2/425, 410, DIG. 11, 2/171, 411, 414, 209.3, 209.7, 182.8, 455, 456, 267; 428/119, 120, 178, 188

(56) References Cited

U.S. PATENT DOCUMENTS

| | | | | | |
|---|---|---|---|---|---|
| 2,051,714 | A | | 8/1936 | Huntington | |
| 4,509,510 | A | * | 4/1985 | Hook | 428/120 |
| 4,619,055 | A | * | 10/1986 | Davidson | 36/28 |
| 4,646,367 | A | | 3/1987 | El Hassen | |
| 4,698,852 | A | | 10/1987 | Romero | |
| 4,910,804 | A | | 3/1990 | Lidgren | |
| 4,947,488 | A | | 8/1990 | Ashinoff | |
| 4,948,116 | A | * | 8/1990 | Vaux | 428/178 |
| 5,023,128 | A | * | 6/1991 | Fatool | 2/267 |
| 5,234,738 | A | * | 8/1993 | Wolf | 428/119 |
| 5,607,749 | A | * | 3/1997 | Strumer | 428/188 |
| 5,640,721 | A | | 6/1997 | Jackson | |
| 5,680,657 | A | * | 10/1997 | Valtakari | 2/455 |
| 5,853,844 | A | * | 12/1998 | Wen | 428/119 |
| 5,951,367 | A | * | 9/1999 | Hsu | 2/267 |
| 5,963,989 | A | | 10/1999 | Robertson | |
| 6,314,586 | B1 | * | 11/2001 | Duguid | 2/411 |
| 6,397,399 | B1 | * | 6/2002 | Lampe et al. | 2/171.2 |
| 6,432,513 | B1 | * | 8/2002 | Thomsen et al. | 2/16 |
| 6,438,761 | B1 | * | 8/2002 | McGarrity | 2/171 |

* cited by examiner

*Primary Examiner*—Rodney M. Lindsey
(74) *Attorney, Agent, or Firm*—Joseph E. Mueth

(57) ABSTRACT

A shock absorbing pad comprising a molded rubbery elastomeric material having a generally smooth surface on the side adapted to abut a soccer player's head and the opposed face having an open grid structure defined by outwardly projecting patterns of short ribs or patterns of short and midsized ribs with at least some of the intersections of the ribs being defined by outwardly projecting cylinders which are taller than ribs or, if both types of ribs are present, the cylinders are taller than both the shortest and the midsized ribs, top-to-bottom to provide airways or passages for the flow of cooling air and to enhance player comfort.

9 Claims, 3 Drawing Sheets

SOCCER HEADBAND

This application claims the benefit of Provisional Patent Application No. 60/175,452, filed Jan. 9, 2000.

BACKGROUND OF INVENTION

This invention is a new and improved embodiment of the invention disclosed in my issued U.S. Pat. No. 5,963,989, issued Oct. 12, 1999, the text and drawings of which are, in toto, expressly incorporated herein by reference. The issued patent discloses a headband adapted to be worn on the head of a soccer player to protect against injury including a resilient padded portion adapted to ride on that area of the head normally used to head a soccer ball. The resilient pad is composed of a material which mitigates the effect on impact on the players head and neck while at the same time maintaining adequate rebound of the ball in a way which does not alter game play.

The preferred resilient pad material disclosed in the issued patent is a rubbery, elastomeric material which has been molded to include primary shock absorbing means comprising first ribs and second ribs intersecting and interconnecting to form a plurality of first sections having a predetermined first height which will absorb initial shock loads imposed by the impact of the soccer ball by deflection and deformation of said primary shock absorbing means. The resilient pad also has a secondary shock absorbing means comprising third ribs and fourth ribs intersecting and interconnected to one another and connected to at least selected of the first sections, the third and fourth ribs having a predetermined second height less than the first height of the first and second ribs. The secondary shock absorbing means are resilient members providing resistance to loads whereby the primary and secondary shock absorbing means cooperate to absorb shock forces and exhibit a non-linear force displacement behavior at predetermined load levels. In general, the primary and secondary shock absorbing members are defined by longer and shorter ribs extending longitudinal and transversely at right angles to each other along the outer surface of resilient pad in an open grid-like pattern on the side intended to impact the soccer ball. The opposed surface is closed and planar and carries the grid-like pattern.

SUMMARY OF INVENTION

The present invention comprises a headband adapted to be worn on the head of a soccer player to protect against injury including a resilient padded portion adapted to ride on that area of the head normally used to head a soccer ball;

the improvement wherein the padded portion is a molded rubbery elastomeric material having a generally flat or smooth surface on the side adapted to abut the soccer player's head and the opposed face having an open grid structure defined by outwardly projecting patterns of short ribs or patterns of short and midsized ribs with at least some of the intersections of the ribs being defined by outwardly projecting cylinders which are taller than ribs or, if both types of ribs are present, the cylinders are taller than both the shortest and the midsized ribs least some of the intersections of the ribs being defined by outwardly projecting cylinders which are taller than the ribs or, if both types of ribs are present, the cylinders are taller than both the shortest and the midsized ribs. The spaces between the ribs are closed at their lower extremities. The cylinders are open, top-to-bottom to provide airways or passages for the flow of cooling air and to enhance player comfort. The spaces between the ribs are closed at their lower extremities. The cylinders are open, top-to-bottom to provide airways or passages for the flow of cooling air and to enhance player comfort.

The taller cylinders provide a more resilient and energy absorbing pad material without disturbing the play of the soccer ball.

The invention further comprehends a shock absorbing pad comprising a molded rubbery elastomeric material having a generally smooth surface on the side adapted to abut a soccer player's head and the opposed face having an open grid structure defined by outwardly projecting patterns of short ribs or patterns of short and midsized ribs with at least some of the intersections of the ribs being defined by outwardly projecting cylinders which are taller than the ribs or, if both types of ribs are present, the cylinders are taller than both the shortest and the midsized ribs wherein said cylinders are open, top-to-bottom to provide airways or passages for the flow of cooling air and to enhance player comfort.

THE DRAWINGS

Turning to the drawings.

DESCRIPTION OF PREFERRED EMBODIMENTS

Considering the drawings in somewhat more detail, the pad is intended to have all of the size, shape and position attributes disclosed in the issued patent. The composition is the same and is a resilient rubbery material that can distort under the impact of the soccer ball, absorb energy and regain its original configuration.

Figure 4:
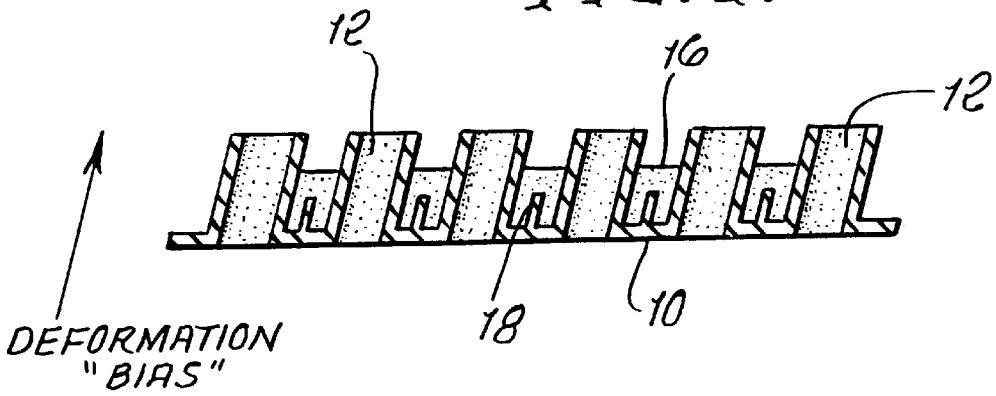
FIG. 4 is a side sectional view of the pad material of FIG. 3.
Figure 5:
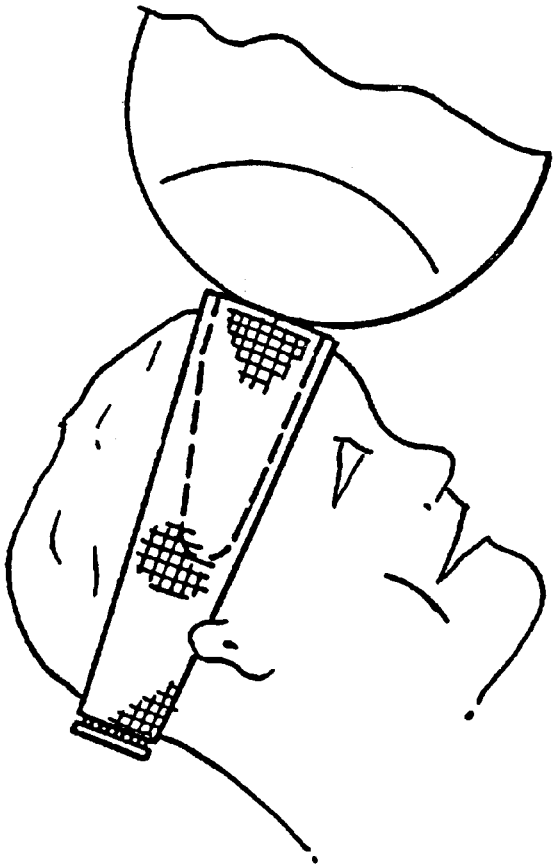
FIG. 5 shows the headband of this invention.

While not shown in the drawings, this invention is applicable to the configuration of the pad including the curvature on the side abutting the players head as shown in FIGS. 4 and 5 of the issued patent.

Figure 1:
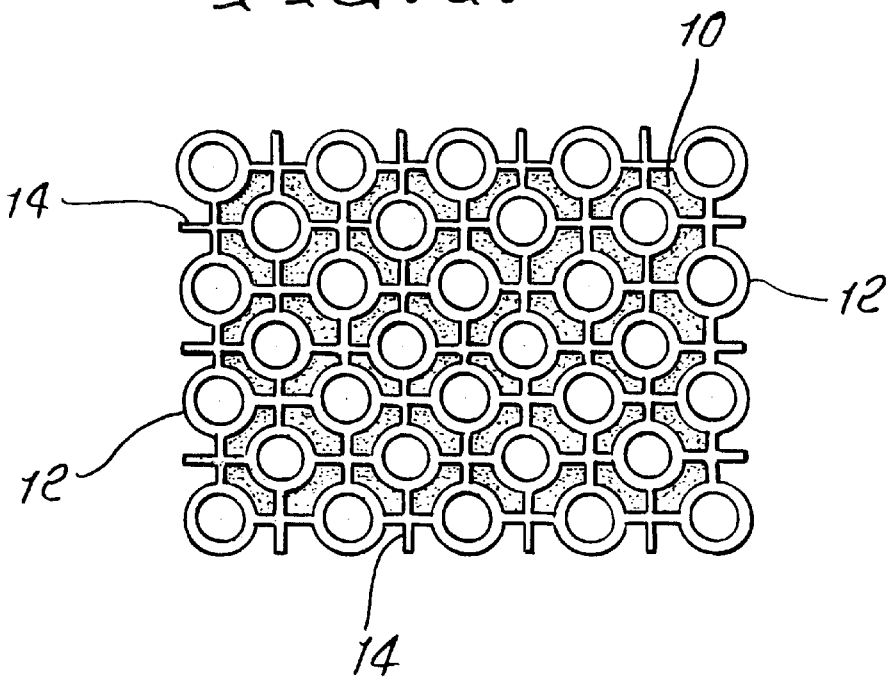
FIG. 1 is a top plan view of the outer surface of the pad material showing one embodiment in which there is a single rib pattern with taller cylinders at all intersections.
Figure 2:
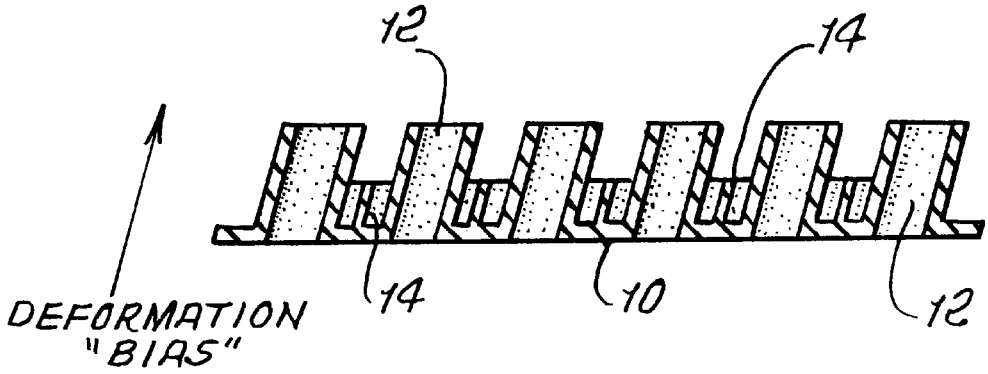
FIG. 2 is a side sectional view of the embodiment of FIG. 1 showing the height of the cylinders open at the bottom extending above the top height of the rib pattern.

In the embodiment of FIGS. 1 and 2, the pad has a generally smooth surface 10 on one side. This surface is intended to abut the players head. The opposed surface comprises cylinders 12 and rib pattern 14 which intersect the cylinders and the individual ribs intersect each other at right angles. The cylinders 12 project above, that is, are higher than the rib pattern. The rib pattern itself is of uniform height. The cylinders 12 are open, top to bottom, to allow for the free flow of air therethrough. This provides for the ability of the pad to breathe and is of significant benefit to the wearing comfort of the pad as worn by the player.

The wall thickness of the cylinders 12 may be greater than the thickness of the web pattern 14.

Figure 3:
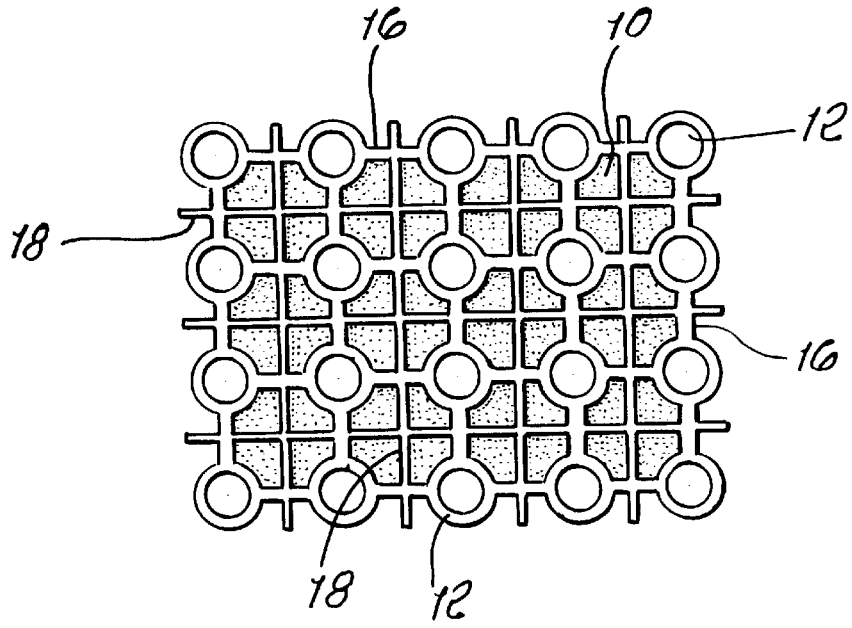
FIG. 3 is another embodiment, this with two rib patterns, one pattern of ribs being higher than the other and having the open cylinders, which are taller than both rib patterns, only at the intersections of the taller of the two rib patterns.

The embodiment of FIGS. 3 and 4, the smooth surface 10 and cylinders 12 are as in the embodiment of FIGS. 1 and 2. The rib pattern is different in that rib pattern 16 intersecting cylinders 12 is higher and thicker than the rib pattern 18 which runs mid-way between the cylinders. By adjusting the rib pattern, it is possible to modify the resilience and energy absorption properties of the pad.

A further improvement is that the pad of this invention is optimally about ½ to about ¾ inches thick at the center and tapered toward the edges vertically and horizontally to a thickness at the margins of from about ⅛ to about ¼ inch.

The following claims are intended to particularly point out and claims the invention.

What is claimed is:

1. A headband adapted to be worn on the head of a soccer player to protect against injury including a resilient padded portion adapted to ride on that area of the head normally used to head a soccer ball, wherein said padded portion has a surface adapted generally to abut the head, said surface being vertically curved to generally conform to the curvature of the head in the area used for heading a soccer ball, said area including the front of the forehead and extending vertically up to and including the area in proximity to the junction of the forehead and the scalp, said resilient pad being composed of a material which mitigates the effect on impact on the players head and neck while at the same time maintaining adequate rebound of the ball in a way which does not alter game play;

the improvement wherein said resilient pad is a molded rubbery elastomeric material having a generally flat or smooth surface on the side adapted to abut the soccer player's head and the opposed face having an open grid structure defined by outwardly projecting patterns of short ribs or patterns of short and midsized ribs with at least some of the intersections of the ribs being defined by outwardly projecting cylinders which are taller than the ribs or, if both types of ribs are present, the cylinders are taller than both the shortest and the midsized ribs.

2. The headband of claim 1 wherein cylinders are open, top-to-bottom to provide airways or passages for the flow of cooling air and to enhance player comfort.

3. A headband adapted to be worn on the head of a soccer player to protect against injury including a padded portion adapted to ride on that area of the head normally used to head a soccer ball, wherein the padded portion is thicker at its upper extremity than at the lower extremity;

the improvement wherein the padded portion is a molded rubbery elastomeric material having a generally flat or smooth surface on the side adapted to abut the soccer player's head and the opposed face having an open grid structure defined by outwardly projecting patterns of short ribs or patterns of short and midsized ribs with at least some of the intersections of the ribs being defined by outwardly projecting cylinders which are taller than the ribs or, if both types of ribs are present, the cylinders are taller than both the shortest and the midsized ribs.

4. The headband of claim 3 wherein the cylinders are open, top-to-bottom to provide airways or passages for the flow of cooling air and to enhance player comfort.

5. A headband adapted to be worn on the head of a soccer player to protect against injury including a padded portion adapted to ride on that area of the head normally used to head a soccer ball, wherein the padded portion is thicker at its center and thinner at its side extremities;

the improvement wherein the padded portion is a molded rubbery elastomeric material having a generally flat or smooth surface on the side adapted to abut the soccer player's head and the opposed face having an open grid structure defined by outwardly projecting patterns of short ribs or patterns of short and midsized ribs with at least some of the intersections of the ribs being defined by outwardly projecting cylinders which are taller than the ribs or, if both types of ribs are present, the cylinders are taller than both the shortest and the midsized ribs.

6. The headband of claim 5 wherein the cylinders are open, top-to-bottom to provide airways or passages for the flow of cooling air and to enhance player comfort.

7. A headband adapted to be worn on the head of a soccer player to protect against injury including a padded portion adapted to ride on that area of the head normally used to head a soccer ball, wherein said padded portion comprises a resilient elastomeric polymeric body member, said resilient body member having air holes therethrough to permit the flow of cooling air and the escape of moisture;

the improvement wherein the padded portion is a molded rubbery elastomeric material having a generally flat or smooth surface on the side adapted to abut the soccer player's head and the opposed face having an open grid structure defined by outwardly projecting patterns of short ribs or patterns of short and midsized ribs with at least some of the intersections of the ribs being defined by outwardly projecting cylinders which are taller than the ribs or, if both types of ribs are present, the cylinders are taller than both the shortest and the midsized ribs.

8. The headband of claim 7 wherein the cylinders are open, top-to-bottom to provide said air holes for the flow of cooling air and to enhance player comfort.

9. A shock absorbing pad comprising a molded rubbery elastomeric material having a generally smooth surface on the side adapted to abut a soccer player's head and the opposed face having an open grid structure defined by outwardly projecting patterns of short ribs or patterns of short and midsized ribs with at least some of the intersections of the ribs being defined by outwardly projecting cylinders which are taller than the ribs or, if both types of ribs are present, the cylinders are taller than both the shortest and the midsized ribs, wherein said cylinders are open, top-to-bottom, to provide airways or passages for the flow of cooling air and to enhance player comfort.

* * * * *